US012060189B2

(12) United States Patent
Gut et al.

(10) Patent No.: US 12,060,189 B2
(45) Date of Patent: Aug. 13, 2024

(54) METHOD AND DEVICE USED TO HANDLE AND PRINT ON PACKAGING BLANKS PROVIDED FOR THE PACKAGING OF ARTICLES

(71) Applicant: Krones Aktiengesellschaft, Neutraubling (DE)

(72) Inventors: Tobias Gut, Unterhaching (DE); Johannes Kirzinger, Munich (DE)

(73) Assignee: Krones Aktiengesellschaft, Neutraubling (DE)

( * ) Notice: Subject to any disclaimer, the term of this patent is extended or adjusted under 35 U.S.C. 154(b) by 472 days.

(21) Appl. No.: 17/431,573

(22) PCT Filed: Jan. 15, 2020

(86) PCT No.: PCT/EP2020/050926
§ 371 (c)(1),
(2) Date: Aug. 17, 2021

(87) PCT Pub. No.: WO2020/173613
PCT Pub. Date: Sep. 3, 2020

(65) Prior Publication Data

US 2022/0111989 A1 Apr. 14, 2022

(30) Foreign Application Priority Data

Feb. 26, 2019 (DE) ..... 10 2019 104 870.2

(51) Int. Cl.
*B65B 61/02* (2006.01)
*B65B 17/02* (2006.01)
(Continued)

(52) U.S. Cl.
CPC ..... *B65B 61/025* (2013.01); *B65B 17/025* (2013.01); *B65B 21/242* (2013.01);
(Continued)

(58) Field of Classification Search
CPC ..... B65B 43/14; B65B 61/025; B65B 17/025
See application file for complete search history.

(56) References Cited

U.S. PATENT DOCUMENTS 3,318,205 A * 5/1967 Lefief ..... B31B 50/46 493/131
6,164,040 A 12/2000 Bowman, Jr. et al.
(Continued)

FOREIGN PATENT DOCUMENTS

DE 19933413 A1 1/2001
DE 202007018468 U1 8/2008
(Continued)

OTHER PUBLICATIONS

PCT Application: PCT/EP2020/050926—Filed: Jan. 15, 2020—PCT Application International Preliminary Report of Patentability (English Translation) dated Sep. 10, 2021.
(Continued)

*Primary Examiner* — Lucas E. A. Palmer
(74) *Attorney, Agent, or Firm* — Simmons Perrine Moyer Bergman PLC

(57) ABSTRACT

Disclosed are a method and a device (1) used to package articles into printed packaging blanks (2). In the method, a plurality of packaging blanks are first positioned in a magazine (4) and subsequently extracted from the magazine (4). Subsequently, articles are brought together with the packaging blanks (2) extracted from the magazine (4) such that a particular packaging blank (2) forms a particular packaging or a particular component of a particular packaging for in each instance at least one article. It is moreover provided that the packaging blanks (2) are printed onto, with the printing onto a packaging blank (2) being carried out temporally after the positioning of the packaging blank (2) in the magazine (4) and temporally before the particular bringing
(Continued)

together of the packaging blank (2) with the particular at least one article. The device (1) can be operated in a corresponding manner.

20 Claims, 6 Drawing Sheets

(51) Int. Cl.

| | |
|---|---|
| ***B65B 21/24*** | (2006.01) |
| ***B65B 43/10*** | (2006.01) |
| ***B65B 43/18*** | (2006.01) |
| ***B65B 57/02*** | (2006.01) |

(52) U.S. Cl.
CPC ..... *B65B 43/10* (2013.01); *B65B 43/185* (2013.01); *B65B 57/02* (2013.01)

(56) References Cited

U.S. PATENT DOCUMENTS

| | | | | |
|---|---|---|---|---|
| 6,250,218 | B1 | 6/2001 | Carini et al. | |
| 9,864,096 | B2 * | 1/2018 | Fujitomi | B65B 43/465 |
| 10,196,163 | B2 * | 2/2019 | Baltes | B65B 43/285 |
| 2007/0074492 | A1 * | 4/2007 | Koga | B65B 5/061 53/512 |
| 2009/0211464 | A1 * | 8/2009 | Till | B65B 61/025 100/2 |
| 2011/0023421 | A1 * | 2/2011 | Izquierdo | B65B 57/10 53/131.2 |
| 2012/0297731 | A1 | 11/2012 | Sandor | |
| 2014/0360133 | A1 * | 12/2014 | Yoshikane | B65B 43/30 53/386.1 |
| 2017/0152067 | A1 * | 6/2017 | Nakamoto | B65B 65/02 |

FOREIGN PATENT DOCUMENTS

| | | | | |
|---|---|---|---|---|
| DE | 102009050712 | A1 | 4/2011 | |
| DE | 202012000263 | U1 | 2/2012 | |
| WO | WO-9951498 | A1 * | 10/1999 | B65B 11/08 |
| WO | WO-2011054435 | A1 * | 5/2011 | B65B 19/228 |

OTHER PUBLICATIONS

PCT Application: PCT/EP2020/050926 Filed: Jan. 15, 2020—International Search Report dated Jun. 9, 2020.
Priority Application: DE 10 2019 104 870.2 Filed: Feb. 26, 2019—German Search Report Dated Sep. 27, 2019.
First Office Action in European Application dated Feb. 13, 2024.

* cited by examiner

METHOD AND DEVICE USED TO HANDLE AND PRINT ON PACKAGING BLANKS PROVIDED FOR THE PACKAGING OF ARTICLES

CLAIM OF PRIORITY

The present application claims priority to International Application PCT/EP2020/050926, filed Jan. 15, 2020, which in turn claims priority to German Application DE 10 2019 104 870.2, filed Feb. 26, 2019, which are incorporated by reference.

FIELD OF THE INVENTION

The present invention relates to a method and a device used to handle and print onto packaging blanks provided for the packaging of articles.

BACKGROUND OF THE INVENTION

The handling of articles frequently involves providing individual or a plurality of articles with an outer packaging.

In the case of individual articles, this is carried out for their improved protection and/or for their improved sales presentation.

In the case of a plurality of articles, a bundle of a plurality of articles is additionally achieved or formed by the outer packaging.

Such bundles represent an effective way of enabling simultaneous handling of a plurality of articles, for instance, to facilitate the simultaneous transport of a plurality of articles. For many articles, such as beverage containers, for example, bundles of a plurality of articles held together thus represent the most frequent type of sales units.

The articles can be, for example, objects, such as packaged or unpackaged objects, containers, such as beverage bottles or cans, or in themselves bundles, in turn, of a plurality of objects, in which the objects of a bundle can be held together, for example, by an embracing around the periphery of a group of objects, such as, for example, a strapping, an outer packaging, such as a wrapping, a shrink tube, or a cardboard packaging or a carrying rack, such as a beverage crate, to name but a few conceivable embodiments.

Among the options used as outer packagings accommodating in each instance one or more articles are folding boxes, as they offer a high degree of protection and additional protection for the articles accommodated therein. Folding boxes are moreover stackable together with the articles accommodated therein. If the folding boxes are printed onto, it is possible to identify the articles accommodated therein by information printed or glued onto their exterior. They can further serve as advertising media by the appropriate information on their exterior.

Folding boxes are industrially prefabricated, mostly cuboid-shaped containers, which have been folded or collapsed to particularly small dimensions or pack sizes, and which are space-savingly transported and stored in a collapsed state until they are used. When they are needed, the folding boxes can be easily unfolded or expanded by hand or machine to form outer packagings, as is known from the folding boxes used for postal packages, for example. In a folded or collapsed state, they require little space for their transport and storage.

Outer packagings formed by folding boxes, for example, can be designed with or without partitions arranged or arrangeable therein for separating and/or keeping apart individual articles from each other, such partitions also being referred to as so-called baskets. So-called interior fittings to be arranged or being arranged in an outer packaging, are referred to as partitions, with the interior fittings consisting, for example, of dividers slotted into each other and/or connected to each other, for example, by bending edges and/or adhesive joints. Such partitions allot fixed positions to the articles inside the outer packagings and thereby protect the articles from colliding with each other and rubbing against each other while the articles are being further transported and/or stored and until they are extracted and used, as the articles colliding and rubbing against each other would otherwise lead to a negative impression of the quality by scuffing, for example, of information applied onto the articles in the form of labels, for example, and/or by the articles damaging each other.

Outer packagings with partitions already arranged therein are moreover known. These can be designed as folding boxes with interior fittings arranged therein, which are likewise transported and stored in a folded or collapsed state, and which are easily unfolded by hand or machine when they are needed.

Outer packagings are preferentially produced from single- or multi-part cardboard packagings of stabilized paper types, such as cardboard and/or paperboard, for example. There are cardboard packagings in different thicknesses and sizes for all types of outer packagings. Corrugated cardboard can be used to protect sensitive articles, for example.

A device and a method are already known from WO 2013/053646 A1 for the combined expanding and unfolding of outer packagings. A gripper seizes one of the cardboard packaging walls and pulls the seized cardboard packaging wall and thus the entire cardboard packaging along a path of movement out of the magazine. The path of movement describes a quarter-circular path along which the cardboard packaging wall seized by the gripper undergoes a 90-degrees swivel movement about an axis extending parallel to the bending edges. During this movement, the cardboard packaging wall, which is not seized by the gripper, of the flat side released by the magazine, which cardboard packaging wall not seized by the gripper in the flatly collapsed state of the cardboard packaging encloses a dull angle of at least approximately 180 degrees with the cardboard packaging wall seized by the gripper, glides along a guiding slot, which, at the end of the path of movement, forces the cardboard packaging wall that is not seized by the gripper to assume an angle of 90 degrees in relation to the cardboard packaging wall that is seized by the gripper such that a rectangular cross section of the shell is achieved. The separately produced bottom and the separately produced lid of the container are subsequently connected to the shell and the container is filled.

As already mentioned, outer packagings with printing on them can serve as advertising media and facilitate the identification of articles accommodated in a particular outer packaging. If a particular outer packaging is intended to have a printing, individual outer packagings are up to now printed onto in an external printing station for this purpose, and are then delivered and stored in a magazine by a user or by machine whereupon the particular, already printed outer packagings accommodated in the magazine are extracted from the magazine and unfolded. In this context it is possible that too many outer packagings have printings applied onto them and that the supply is not required for packaging the particular type of articles. This results in a number of rejects for the outer packagings, which is undesirable not least for economic reasons. By contrast, it is also conceivable that a particular supply of already printed outer packagings is not sufficient such that a particular packaging process for articles has to be interrupted until further printed outer packagings are available or delivered. The devices as are known from the prior art accordingly have a limited flexibility if articles are to be packaged into outer packagings with printings applied onto them.

It is the object of the invention to provide a possibility that makes it possible to supply printed packaging materials with a high degree of flexibility and in an uncomplicated manner.

The above task is fulfilled by the objects comprising the features in the independent claims. Further advantageous embodiments of the invention are described in the subclaims.

SUMMARY OF THE INVENTION

The invention relates to a method used to package articles into printed packaging blanks. The articles that can be packaged by the packaging blanks can be beverage containers, for example. The beverage containers can be designed as beverage bottles and/or as beverage cans, for example. The articles that can be packaged by the packaging blanks can also be formed by bundles, for example, which each have a plurality of beverage containers that are already being held together.

One step of the method provides a positioning of a plurality of packaging blanks in a magazine. Embodiments have proved successful, in which, for example, the plurality of packaging blanks are positioned in the magazine in an upright standing manner and arranged one after the other. In this context, a plurality of packaging blanks can be positioned in the magazine in an upright standing manner and arranged one after the other in such a manner that immediately adjacent packaging blanks are in surface contact or abut on each other with their particular broadside surfaces. It is conceivable that a manipulator or a handling apparatus is provided, which positions the plurality of packaging blanks in the magazine in an upright standing manner and arranged one after the other. A particular broadside surface of the packaging blank arranged in the magazine in the particular standing positioning can be obliquely oriented or at least approximately vertically oriented.

It is also possible that the plurality of packaging blanks are positioned in the magazine in a lying position and stacked on top of each other. In this context, the plurality of packaging blanks can be positioned in the magazine in a lying position and stacked on top of each other in such a manner that immediately adjacent packaging blanks are in surface contact with their particular broadside surfaces or in such a manner that immediately adjacent packaging blanks lie on top of each other with their broadside surfaces. It is conceivable that a manipulator or a handling apparatus is provided, which positions the plurality of packaging blanks in the magazine in a lying position and stacked on top of each other.

A further step of the method provides an extraction of the packaging blanks from the magazine. In this context it is possible that one packaging blank is extracted from the magazine in each instance or that the packaging blanks are extracted from their common magazine successively. One step of the method can thus provide an extraction of the packaging blanks from the magazine in an upright standing manner and arranged one after the other. Another step of the method can provide an extraction from the magazine of the packaging blanks positioned in the magazine in a lying position and stacked on top of each other.

It is moreover conceivable that the packaging blanks arranged one after the other or on top of each other are extracted from the magazine, expanded, and each transported toward at least one article provided for being packaged into the particular extracted and by then expanded packaging blank. The plurality of packaging blanks can thus be positioned in the magazine in a collapsed state and in an upright standing manner arranged one after the other. The plurality of packaging blanks can also be positioned in the magazine in a collapsed state and stacked on top of each other. The particular packaging blank can be unfolded or expanded temporally during the extraction and/or temporally during the transport toward the at least one article provided to be packaged in the particular extracted packaging blank. The plurality of packaging blanks arranged in the magazine can thus be designed as collapsed or folded outer packaging and/or as collapsed or folded partition.

It is moreover conceivable that a plurality of packaging blanks are positioned in the magazine in an upright standing manner and arranged one after the other or stacked on top of each other, which packaging blanks are designed to be flat and borderless and to form a support surface for the articles. Such packaging blanks are referred to as pads in practice and can contribute to the stability of a plurality of articles packaged by the pad. It is also possible that the packaging blanks are positioned in the magazine in a collapsed state and in an upright standing manner arranged one after the other or stacked on top of each other are unfolded and expanded temporally during the extraction and/or temporally during the transport toward the at least one article provided to be packaged into the particular extracted packaging blank, and are subsequently available as cardboard packaging to accommodate a plurality of articles. In the present context, the term "packaging blank" is thus to be understood in a broad sense, and it comprises all packaging materials that are printable onto and that are suitable for the packaging of articles and, in particular, for the form-locking and/or force-locking assembly of a plurality of articles into a particular packaging unit. The packaging materials are preferably made from cardboard, paperboard, and/or plastic.

A further step provides bringing together the packaging blanks extracted from the magazine with articles such that a particular packaging blank hereby forms a particular packaging or a particular component of a particular packaging for in each instance at least one article. For the purpose of bringing together the packaging blanks and the articles, it is possible that a particular packaging blank extracted from the magazine is deposited, and a plurality of articles are placed preferably in a direction coming from above into the deposited packaging blank. In this context it is possible that a packaging blank that is at least in some areas still open until the plurality of articles are placed in a direction coming from above into the packaging blank is closed temporally after the plurality of articles has been placed into the packaging blank. For this purpose, a flap of the packaging blank can be folded in and can be secured in a folded-in orientation by a material-bonded connection or an adhesive bond.

It is also conceivable that a packaging unit formed from articles and a particular packaging blank is placed into a further packaging. Such further packagings referred to in practice as tertiary packagings can be provided in order to assemble a plurality of packaging units in a larger packaging unit.

It is also possible that a particular packaging blank is applied and/or deposited onto a plurality of articles for the purpose of bringing together the packaging blanks and the articles, in which instance the plurality of articles can be located on a horizontal conveying device.

It is provided that the packaging blanks are printed onto, with the printing onto a particular packaging blank being carried out temporally after the positioning of the packaging blank in the magazine and temporally before the particular bringing together of the packaging blank with the particular at least one article. If the plurality of packaging blanks are positioned in the magazine in an upright standing manner, it is possible that the packaging blanks are printed onto, with the printing onto a particular packaging blank being carried out temporally after the standing positioning of the packaging blank in the magazine and temporally before the particular bringing together of the packaging blank with the particular at least one article. If the plurality of packaging blanks are positioned in the magazine in a lying position and stacked on top of each other, it is possible that the packaging blanks are printed onto, with the printing onto a particular packaging blank being carried out temporally after the lying and stacked positioning of the packaging blank in the magazine and temporally before the particular bringing together of the packaging blank with the particular at least one article.

This results in the possibility to print onto packaging blanks depending on the particular actual requirements shortly before the placing of the articles thereinto such that the production of unneeded rejects of packaging blanks can be advantageously prevented. The possibility of printing shortly before the placing of the articles into the packagings moreover ensures that it is always possible to supply or to produce, a sufficient quantity of printed outer packagings.

In the context of the printing, it is possible to apply a print image designed as, for example, QR code, spray marking, and/or country code, onto the particular packaging blank. The print image applied onto the packaging blank in the context of the printing can also supply information on the articles to be packaged in the particular packaging blank, for example, a use by date, a best before date, and/or information about the particular producer. It is moreover possible to supply a RFID code and/or the option of bio-tracking via the print image.

As already mentioned above, it is possible that the plurality of packaging blanks are positioned in the magazine in a collapsed state and in an upright standing manner arranged one after the other or in a collapsed state and stacked on top of each other. Each of the plurality of packaging blanks can be designed as a collapsed outer packaging with a front side and a side wall, which can form the particular expanded outer packaging, being arranged next to each other and located at least approximately on a same plane in the collapsed orientation of the particular packaging blank. As a result of the collapsed orientation of the particular packaging blank, it is possible to print immediately successively onto a particular front side and a particular side wall, which can form the particular expanded outer packaging.

It has proved successful to print onto the packaging blanks temporally after the positioning of the packaging blanks in the magazine and temporally before the extraction of the packaging blanks from the magazine. The packaging blanks can thus be printed onto while they are still inside the magazine. In particular, it is possible in this context to position the plurality of packaging blanks in the magazine in an upright standing manner and arranged one after the other with the packaging blanks being printed temporally after the positioning of the packaging blanks, in the magazine in the upright standing manner and arranged one after the other, and temporally before the extraction of the packaging blanks from the magazine.

At least one printhead can print onto a particular packaging blank positioned in the magazine while the particular packaging blank positioned in the magazine is located inside the magazine. It is possible in this context that the plurality of packaging blanks are, in particular, positioned in the magazine in an upright standing manner and arranged one after the other and that in this context at least one printhead prints onto a particular packaging blank positioned in the magazine, in particular, foremost in an upright standing manner, while the particular packaging blank positioned in the magazine, in particular, foremost in an upright standing manner, is located inside the magazine. It is also conceivable that the plurality of packaging blanks are positioned in the magazine in a lying position and stacked on top of each other, and that in this context at least one printhead prints onto a particular packaging blank positioned in the magazine in a lying position, while the particular packaging blank positioned in the magazine in a lying position is located inside the magazine.

The at least one printhead can carry out a travel movement oriented in horizontal direction and/or in vertical direction during the printing onto the particular packaging blank positioned in the magazine, in particular, foremost in an upright standing manner or in a lying position. While the travel movement oriented in horizontal direction and/or in vertical direction is being carried out, the at least one printhead can be in surface contact with the particular packaging blank positioned in the magazine, in particular, foremost in an upright standing manner or in a lying position. It is possible that a vertical position of the at least one printhead is fixedly specified or fixedly adjusted. During the printing onto a packaging blank positioned in the magazine foremost in an upright standing manner, the at least one printhead can be moved horizontally and in this context maintain the fixedly specified or fixedly adjusted vertical position. As a result, it is possible to flexibly coordinate a vertical position of the at least one printhead with a dimensioning of a particular packaging blank and/or with a particular print image to be produced. Embodiments have proved successful in which a vertical position of the at least one printhead can be fixedly specified or fixedly adjusted by a user and in a toolless manner.

The at least one printhead can have a first printhead and a second printhead, or it can be formed by a first printhead and a second printhead. It is possible that the first printhead and the second printhead interact in order to print onto a particular packaging blank positioned in the magazine, in particular, foremost in an upright standing manner or in a lying position. In this instance, the first printhead and the second printhead can apply a common print image onto a particular packaging blank positioned in the magazine, in particular, foremost in an upright standing manner or in a lying position. It is conceivable that the first printhead and the second printhead are moved time-synchronously or simultaneously during the printing onto a particular packaging blank positioned in the magazine, in particular, foremost in an upright standing manner or in a lying position.

It is also possible that a particular packaging blank positioned in the magazine, in particular, foremost in an upright standing manner or in a lying position, is printed onto by the first printhead, while the second printhead remains in a waiting position temporally during the printing onto the particular packaging blank positioned in the magazine, in particular, foremost in an upright standing manner or in a lying position. If required, it is possible that the second printhead is maintained or repaired in the waiting position.

A sensor system can be provided by which it is checked whether a packaging blank positioned in the magazine, in particular, foremost in an upright standing manner or in a lying position, is located within a defined print range. In this instance, it is possible that an approval is issued for the at least one printhead to print onto a particular packaging blank positioned in the magazine, in particular, foremost in an upright standing manner or in a lying position, if it is determined by the sensor system in the context of the check that a particular packaging blank positioned in the magazine, in particular, foremost in an upright standing manner or in a lying position, is located within the print range. Furthermore, it is possible that an approval for the at least one printhead to print is disabled if it is determined by the sensor system in the context of the check that no packaging blank positioned in the magazine, in particular, foremost in an upright standing manner or in a lying position, is arranged within the print range.

It is also possible that a sensor system is provided by which a position and/or orientation is determined of a particular packaging blank positioned in the magazine, in particular, foremost in an upright standing manner or in a lying position. A travel movement of the at least one printhead, the travel movement being provided for the purpose of printing, can be coordinated with the particular position and/or orientation determined by the sensor system. In particular, a travel movement of the at least one printhead, the travel movement being provided for the purpose of printing, can be coordinated with the particular position and/or orientation determined by the sensor system in such a manner that after the printing, a print image produced in the context of the printing is located at least approximately at the intended or specified position on the particular packaging blank.

Furthermore, a particular packaging blank positioned in the magazine, in particular, foremost in an upright standing manner or in a lying position, can be extracted from the magazine by a suction device and/or gripping device temporally after the printing, with a movement of the suction device and/or gripping device, the movement being provided for the purpose of extracting a particular packaging blank positioned in the magazine, in particular, foremost in an upright standing manner or in a lying position, and a travel movement of the at least one printhead, the travel movement being provided for the purpose of printing, being temporally coordinated with each other in such a manner that the suction device and/or gripping device and the at least one printhead do not collide with each other.

In particular, it is thus possible that a movement of the specific suction device and/or gripping device is temporally coordinated with the travel movement of the at least one printhead, the travel movement being provided for the purpose of printing, in such a manner that an undesired collision of the specific suction device and/or gripping device with the at least one printhead can be excluded.

It is also possible to apply a printing onto the packaging blanks temporally during a particular extraction of the packaging blanks and/or temporally during a transport of the packaging blanks toward the articles.

It is also possible in this context that a first printing is applied onto a particular packaging blank positioned in the magazine, in particular, foremost in an upright standing manner or in a lying position, and that a second printing is applied onto a particular packaging blank temporally after the extraction of the packaging blank and/or temporally during a transport of the packaging blank toward the articles to be packaged. It is also conceivable for various embodiments that a printing is applied onto a particular packaging blank exclusively temporally during the extraction of the packaging blank and/or temporally during the transport of the packaging blank toward the articles to be packaged.

As the case may be, a particular packaging blank can be extracted from the magazine, in particular, in an upright standing manner, by a suction device and/or gripping device and can hereafter be transported toward the particular articles with which the particular packaging blank is then brought together, with the suction device and/or gripping device printing onto a particular packaging blank temporally during the extraction of the packaging blank and/or temporally during the transport of the particular packaging blank toward the particular articles.

The invention moreover relates to a device used to handle packaging blanks provided for the packaging of articles. Features that have already been mentioned above regarding various embodiments of the method can likewise be provided for various embodiments of the device described below and are therefore not repeatedly mentioned. Features described below regarding various embodiments of the device can likewise be provided for various embodiments of the previously described method. The device can be designed for the implementation of the embodiments of the above-described method.

The device comprises a magazine by which packaging blanks can be supplied. In particular, the device can comprise a magazine by which packaging blanks can be supplied in an upright standing manner and arranged one after the other. In this context it is possible that the device comprises exactly one magazine by which a plurality of packaging blanks can be supplied, in particular, in an upright standing manner and arranged one after the other. In other embodiments, the device can comprise a plurality of magazines by which in each instance a plurality of packaging blanks can be supplied, in particular, in an upright standing manner and arranged one after the other. It is also possible that the device comprises a magazine by which the packaging blanks can be supplied in a lying position and stacked.

The device furthermore comprises a transfer apparatus, which can extract packaging blanks from the magazine and transport the packaging blanks toward articles to be packaged into the packaging blanks. In particular, the device can comprise a transfer apparatus, which can extract packaging blanks from the magazine in an upright standing manner and transport the packaging blanks toward articles to be packaged into the packaging blanks.

The device furthermore comprises at least one printing apparatus used to print onto packaging blanks.

It is provided that the at least one printing apparatus is designed to print onto packaging blanks stored in the magazine and/or that the at least one printing apparatus is arranged at the transfer apparatus or that the at least one printing apparatus is supported by the transfer apparatus. It is conceivable in this context that the at least one printing apparatus is designed to print onto packaging blanks stored in the magazine in an upright standing manner. It is also possible that the at least one printing apparatus is designed to print onto packaging blanks stored in the magazine in a lying position and stacked.

The at least one printing apparatus can comprise at least one printhead, which can print onto a particular packaging blank positioned in the magazine. In particular, the at least one printing apparatus can comprise at least one printhead, which can print onto a particular packaging blank positioned in the magazine foremost in an upright standing manner.

The device can furthermore comprise a reservoir accommodating printing fluid or printing ink for the supply of the printing apparatus. The reservoir can be arranged in a stationary manner or so as not to be movable together with the at least one printhead. The reservoir can thus be designed as an external reservoir, which can be fluidically coupled with the printing apparatus in order to supply the printing apparatus with printing fluid or with printing ink.

The at least one printing apparatus can also comprise a first printhead and a second printhead. It is possible that the first printhead and the second printhead interact in order to print onto a particular packaging blank positioned in the magazine, in particular, foremost in an upright standing manner and in a collapsed state. It is furthermore possible that a particular packaging blank positioned in the magazine, in particular, foremost in an upright standing manner, is printable onto optionally by the first printhead or the second printhead, wherein the particular first or second printhead not provided for the purpose of printing can in this context assume a waiting position. The waiting position can be designed to be at the side of the magazine or at the side of a particular packaging blank positioned in the magazine, in particular, foremost. The waiting position can be designed in such a manner that the particular first or second printhead not provided for the purpose of printing can be maintained and/or repaired in the assumed waiting position if required.

The device can comprise a control apparatus and/or regulating apparatus as well as a sensor system, which is in communication with the control apparatus and/or regulating apparatus. Where appropriate, the control apparatus and/or regulating apparatus can check by the sensor system whether a packaging blank positioned in the magazine, in particular, foremost in an upright standing manner or in a lying position, is located within a defined print range. The control apparatus and/or regulating apparatus can furthermore be designed in such a manner that the control apparatus and/or regulating apparatus issues an approval for the at least one printhead to print onto a particular packaging blank positioned in the magazine, in particular, foremost in an upright standing manner, or in a lying position, if the control apparatus and/or regulating apparatus determines in the context of the check that a particular packaging blank positioned in the magazine, in particular, foremost in an upright standing manner or in a lying position, is located within the print range. The control apparatus and/or regulating apparatus can furthermore be designed in such a manner that the control apparatus and/or regulating apparatus disables an approval for the at least one printhead to print, if the control apparatus and/or regulating apparatus determines in the context of the check that no packaging blank positioned in the magazine, in particular, foremost in an upright standing manner or in a lying position, is located within the print range.

The device can also comprise a sensor system designed for the determination of a position and/or orientation of a particular packaging blank positioned in the magazine, in particular, foremost in an upright standing manner, wherein the sensor system and the at least one printing apparatus are in operative connection with each other in such a manner that a travel movement of the at least one printhead, the travel movement being provided for the purpose of printing, is coordinated with a particular position and/or orientation, as determined by the sensor system, of a particular packaging blank positioned in the magazine, in particular, foremost in an upright standing manner.

Such embodiments have moreover proved successful in which the transfer apparatus comprises a suction device and/or gripping device, which can extract packaging blanks from the magazine, in particular, in an upright standing manner and transport the packaging blanks toward articles to be packaged into the packaging blanks. In this context it is possible that a travel movement of the at least one printhead, the travel movement being provided for the purpose of printing, is coordinated with a movement of the suction device and/or gripping device in such a manner that the suction device and/or gripping device and the at least one printhead do not collide with each other.

BRIEF DESCRIPTION OF THE FIGURES

In the following passages, the attached figures further illustrate typical embodiments of the invention and their advantages. The size ratios of the individual elements in the figures do not necessarily reflect the real size ratios. It is to be understood that in some instances various aspects of the invention may be shown exaggerated or enlarged in relation to other elements to facilitate an understanding of the invention.

Figure 1:
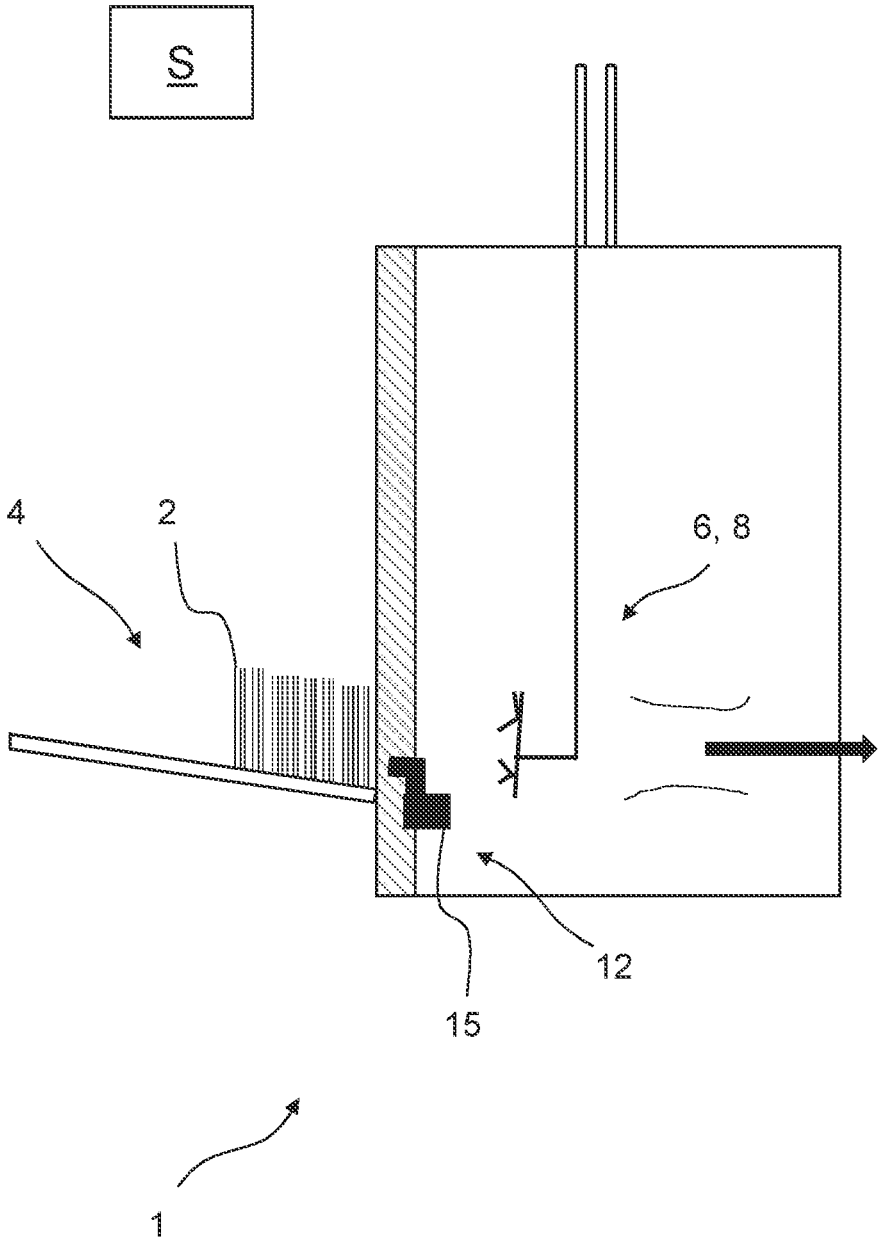
FIG. 1 shows a schematic view of an embodiment of a device according to the invention.

The embodiments, examples and alternatives of the preceding paragraphs, the claims, or the following figures and description, including any of their various aspects or respective individual features, may be taken independently or in any combination. Features described in connection with one embodiment are applicable to all embodiments, unless such features are incompatible.

If illustrations and aspects are generally referred to as being "schematic" in the context of the figures, this is by no means intended to imply that the illustration of the figures and their description are of inferior significance with regard to the disclosure of the invention. The person skilled in the art is fully capable of gathering sufficient information from the schematically and abstractly drawn illustrations for facilitating the understanding of the invention without the understanding being in any way impaired by, for example, the size ratios being drawn and being potentially not precisely true to scale. On the basis of the more concretely explained realizations of the method according to the invention and on the basis of the more concretely explained functionality of the device according to the invention in the figures, the person skilled in the art as a reader is thus enabled to derive a better understanding of the inventive idea, which is formulated in a more general and/or more abstract manner in the claims and in the general part of the description.

The same or equivalent elements of the invention are designated using identical reference characters. Furthermore and for the sake of clarity, only the reference characters relevant for describing the individual figures are provided. It should be understood that the detailed description and specific examples, while indicating preferred embodiments, are intended for purposes of illustration only and are not intended to limit the scope of the invention.

DETAILED DESCRIPTION OF THE INVENTION

FIG. 1 shows a schematic view of an embodiment of a device 1 according to the invention. The device 1 is designed to handle packaging blanks 2, with the packaging blanks 2 being provided to accommodate beverage containers, which are not illustrated in the figures of the present patent application.

The device 1 comprises a magazine 4, by which a plurality of packaging blanks 2 are stored in an upright standing manner and in a collapsed state. It is moreover discernible from FIG. 2 that a plurality of magazines 4, or, more precisely in the present case, three magazines 4 are provided, which each store packaging blanks 2.

Moreover, a transfer apparatus 6 is provided, which is designed as suction device and/or gripping device 8. The suction device and/or gripping device 8 can extract a particular packaging blank 2 positioned in the magazine 4, foremost in an upright standing manner and in a collapsed state, from the magazine 4, unfold the packaging blank 2, and then transfer it to a target location 20 illustrated in FIG. 2 and deposit it there. In the area of the target location 20, a horizontal conveying device can be provided, for example, onto which the suction device and/or gripping device 8 deposits expanded packaging blanks 2, whereupon the suction device and/or gripping device 8 is returned toward the magazine 4. On the horizontal conveying device, the deposited packaging blank 2 is then brought together with articles. For this purpose, a plurality of beverage containers are placed into the packaging blank 2, which continues to be expanded. Together with the beverage containers placed thereinto, the packaging blank 2 is then removed by the horizontal conveying device and closed, for which purpose a top and/or lateral flap of the packaging blank 2 can be folded in and can be secured, for example, by an adhesive.

In devices as known from the prior art, it is up to now provided that packaging blanks 2 are printed onto and are only temporally thereafter placed into a magazine 4. Such a printing can contain information, for example, on the particular beverage containers accommodated by the packaging blank 2. Printings can also display QR codes or information about the particular producer. Furthermore, printings can contain graphic illustrations intended to lend an attractive visual appearance to the packaging blanks 2.

Since packaging blanks that have already been printed onto and adapted to the particular accommodated beverage containers are frequently not available in the required quantity, the device 1 comprises a printing apparatus 12 with a printhead 15. By a particular magazine 4, a particular, upright standing packaging blank 2 is supplied in a still collapsed state. The foremost, up to then still collapsed packaging blank 2 supplied by the magazine 4 in an upright standing manner is then printed onto by the printing apparatus 12 or by the printhead 15 of the printing apparatus 12 while the particular packaging blank 2 is still located in the magazine 4 during the printing. Only temporally after the printing onto a particular packaging blank 2 is fully completed can the particular packaging blank 2 then be extracted from the magazine 4, expanded, and brought to the particular target location 20 by the transfer apparatus 6 or by the suction device and/or gripping device 8. In order to prevent a collision of the suction device and/or gripping device 8 with the printing apparatus 12 or with the printhead 15 a travel movement of the printhead 15 and a movement of the suction device and/or gripping device 8 are coordinated with each other. For this purpose, the printing apparatus 15 and the suction device and/or gripping device 8 are in communication with the control apparatus and/or regulating apparatus S, which specifies the travel movement of the printhead 15 and the movement of the suction device and/or gripping device 8.

Figure 2:
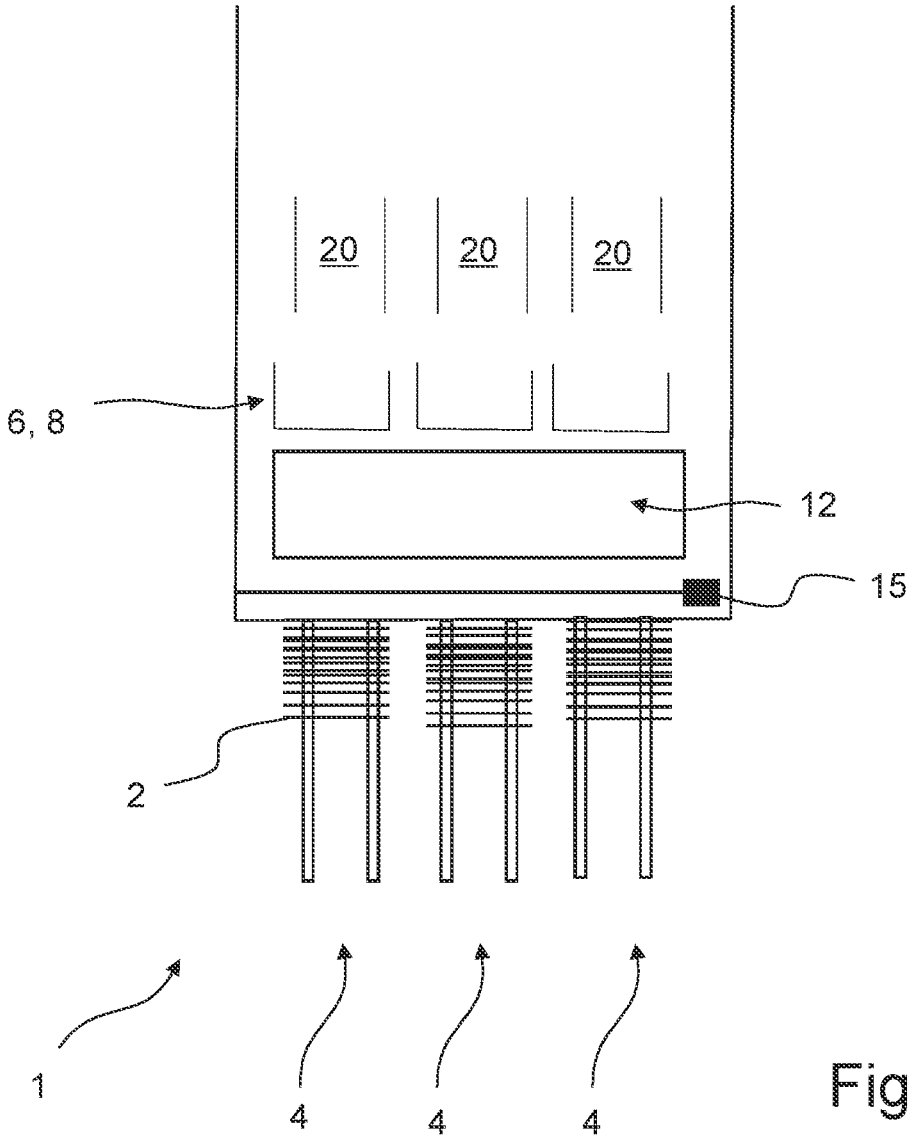
FIG. 2 shows a schematic top view of the embodiment of a device according to FIG. 1.

In additional consideration of FIG. 2, it is discernible that a plurality of magazines 4 are provided, in which in each instance packaging blanks 2 are stored in an upright standing manner and in a collapsed state. The transfer apparatus 6 can comprise an own suction device and/or gripping device 8 for each magazine 4, by which suction device and/or gripping device 8 the transfer apparatus 6 can extract packaging blanks 2 from the particular magazine 4 and deposit them at an own target location 20. In this instance, the printhead 15 or a single printhead 15 can be previously moved along the plurality of magazines 4 and can apply a particular print image onto packaging blanks 2 positioned in the magazines 4 foremost in an upright standing manner and in a collapsed state. A single printhead 15 can thus be sufficient to apply a particular print image onto packaging blanks 2 that are arranged in a plurality of magazines 4.

In addition to the already illustrated components, the device 1 illustrated in the FIGS. 1 and 2 can comprise further components that are not shown here. For example, the control apparatus and/or regulating apparatus S can be in communication with a sensor system, which detects whether a particular packaging blank 2 of the particular magazine 4 is ready for printing. Only if this is the case can the control apparatus and/or regulating apparatus S control the printing apparatus 12 to move the printhead 15. If the control apparatus and/or regulating apparatus S detects that due to an error or due to a depleted supply of packaging blanks 2 in a magazine 4, there is no packaging blank 2 supplied for printing, the control apparatus and/or regulating apparatus S can disable a movement for the printhead 15. It can hereby be prevented that the printhead 15 is inadvertently damaged or that problems occur during the packaging of articles due to the lack of packaging blanks 2 at the target location 20.

Instead of the one printhead 15 designed as component of the printing apparatus 12 as shown in the FIGS. 1 and 2, it can be provided that the printing apparatus 12 has a plurality of printheads 15, which interact in printing onto a particular packaging blank 2 or which print onto a packaging blank 2 together.

Figure 3:
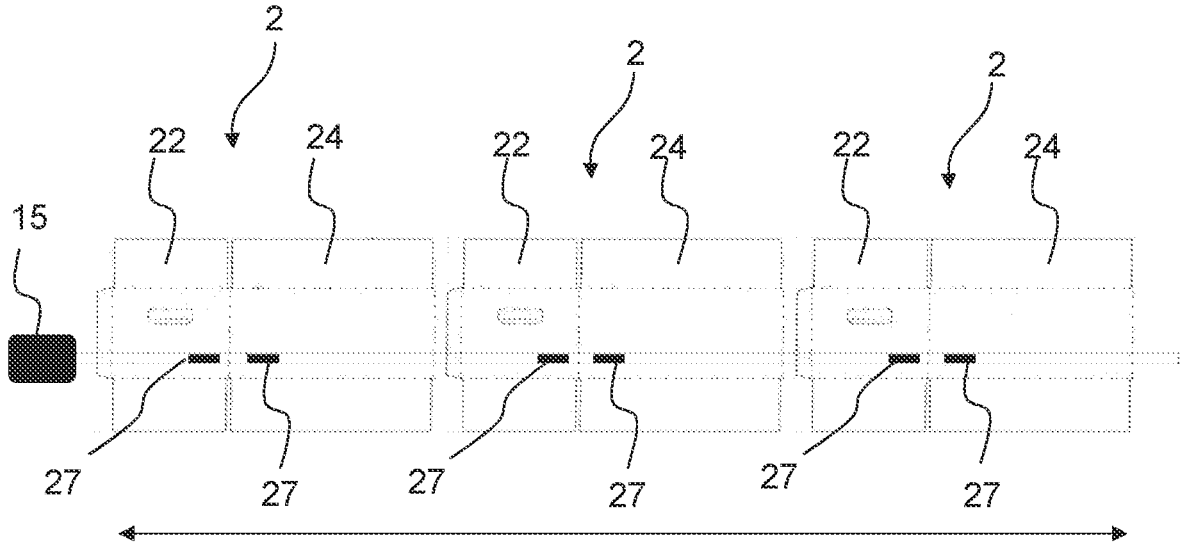
FIG. 3 shows individual aspects such as can be provided in various embodiments of the device according to the invention and in various embodiments of the method according to the invention.

FIG. 3 shows individual aspects such as can be provided in various embodiments of the device 1 according to the invention and in various embodiments of the method 10 according to the invention. In particular, FIG. 3 shows a particular packaging blank 2 arranged foremost in a particular magazine 4 according to FIG. 2. The packaging blanks 2 in FIG. 3 are each designed as an outer packaging, and they are located in a collapsed state in their particular magazine 4. By a suction device and/or gripping device 8 as shown in FIG. 1, the packaging blanks 2 are extracted from the particular magazine 4 and subsequently expanded or unfolded for which purpose the packaging blanks 2 each comprise defined folding lines and bending lines.

In their unfolded orientation, the outer packagings to be formed by unfolding the packaging blanks 2 each have a front side and a side wall. The front side is referred to as reference number 22 in FIG. 3 and the side wall with the number 24. If the particular packaging blank 2 is positioned in the particular magazine 4 as a collapsed outer packaging (cf. FIG. 2), the front side 22 and the side wall 24 are located on one plane and next to each other, as is discernible from the schematic illustration according to FIG. 3. Both the front side 22 and the side wall 24 of a particular packaging blank 2 can hereby be advantageously printed onto by a single printhead 15, with the printhead 15 having to be moved exclusively in horizontal direction corresponding to the arrow-based illustration. It is also not necessary to turn around the packaging blank 2 in order to print onto both the front side 22 and the side wall 24. The printing can thus be carried out by a device 1 with a simple and uncomplicated structure because it is possible to dispense with devices that are up to now necessary for turning around the packaging blanks 2.

In FIG. 3, a print image 27 has already been applied onto each particular front side 22 and onto each particular side wall 24, as is merely schematically indicated in FIG. 3. During or after the extraction of the particular collapsed packaging blank 2 from the particular magazine 4, the particular packaging blank 2 is expanded, in which process the front side 22 and the side wall 24 are bent, or, more precisely, swiveled relative to each other about a vertically oriented axis. The dimensioning of the front side 22 and the side wall 24 illustrated in FIG. 3 is to be understood merely as an example. It is possible, for example, that an extension of the front side 22 in relation to an extension of the particular side wall 24 in horizontal direction is designed larger, or that an extension of the front side 22 and an extension of the side wall 24 in horizontal direction are designed at least approximately identical.

FIG. 4 show exemplary embodiments of packaging blanks 2 such as can be provided in various embodiments of the device according to the invention for the implementation of the method 10 according to the invention (cf. FIG. 5) and such as can be stored in a magazine 4 (cf. FIGS. 1 and 2) in various embodiments of the device 1 according to the invention. The packaging blank 2 illustrated in FIG. 4A is designed as a so-called tray. The tray can form an outer packaging for a plurality of articles, and it comprises a plurality of lateral edge areas 7 (cf. FIG. 4A). By a printing apparatus 12, a printing can be applied in each instance onto the outside of the lateral edge areas 7. The packaging blank 2 illustrated in FIG. 4B is designed as a so-called pad and comprises two broadside surfaces on oppositely located sides, an upper one of which broadside surfaces forms a support surface for articles. The pad or one or both of the two broadside surfaces located opposite each other can furthermore be printed onto by a printing apparatus 12 or by a printhead 15.

Figure 4A:
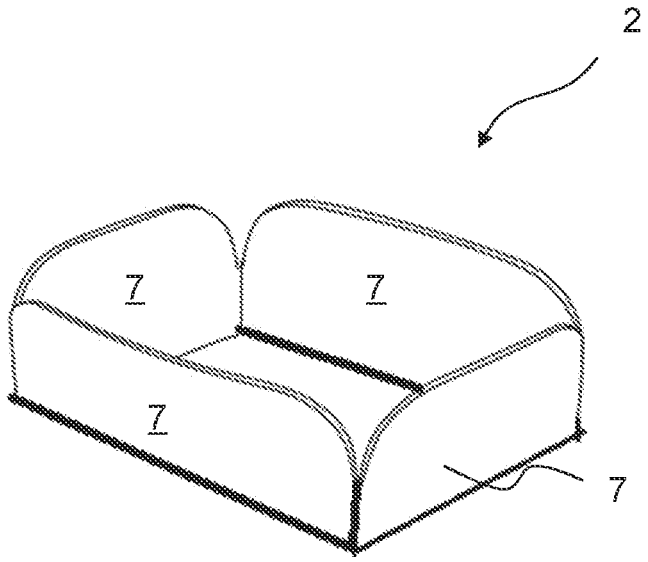
FIGS. 4A-4D show exemplary embodiments of packaging blanks such as can be provided in various embodiments of the device according to the invention for the implementation of the method according to the invention and such as can be stored in a magazine in various embodiments of the device according to the invention.
Figure 4B:
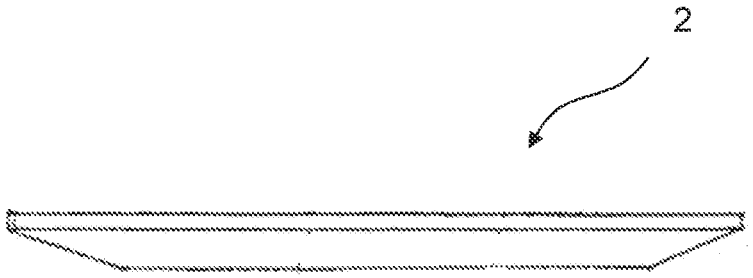
Figure 4C:
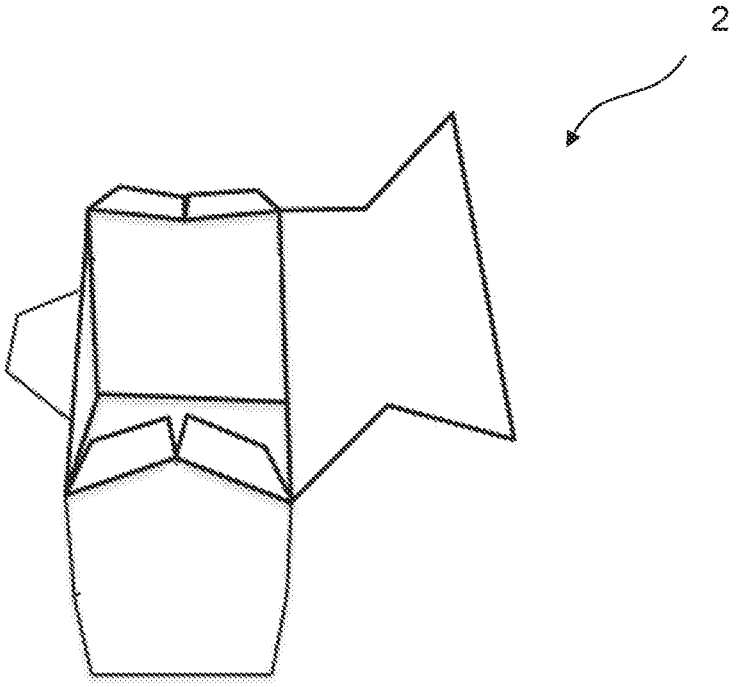

Discernible in FIG. 4C is a packaging blank 2 designed as cardboard packaging, which can accommodate a plurality of beverage containers or into which a plurality of beverage containers can be placed. In the context of an embodiment of the method 10 according to the invention, it can be provided, in particular, that a packaging blank 2 designed as cardboard packaging according to FIG. 4C is printed onto on at least one outside arranged side while the packaging blank 2 designed as cardboard packaging is located in a magazine 4 (cf. FIGS. 1 and 2) in a collapsed state.

Figure 4D:
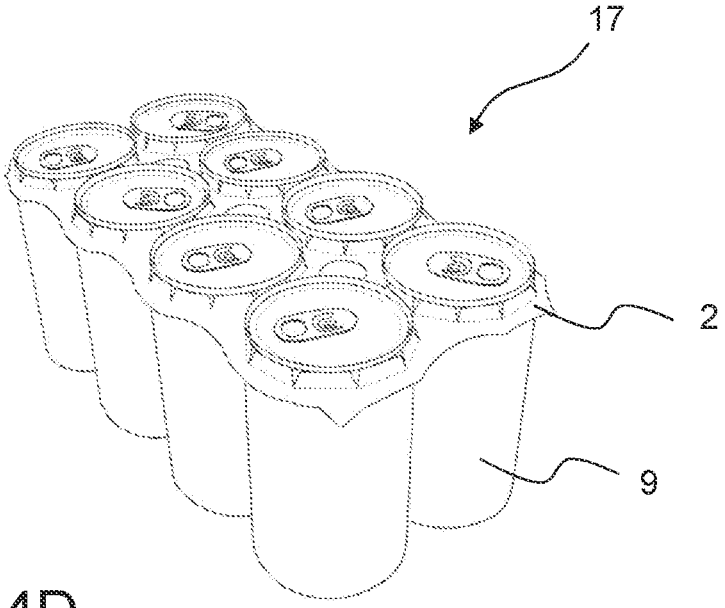

FIG. 4D shows another embodiment of a packaging blank 2, which in FIG. 4D is holding together a plurality of beverage cans 9. In this context, the packaging blank 2 and the beverage cans 9 form a bundle 17. A packaging blank 2 corresponding to the embodiment according to FIG. 4D can also be printed onto in some areas or completely in various embodiments of the method 10 according to the invention by various embodiments of the device 1 according to the invention. It can be provided in this context that the packaging blank 2 according to FIG. 4D is printed onto while the packaging blank 2 is located in a magazine 4 (cf. FIGS. 1 and 2). The printed packaging blank 2 can subsequently be extracted from the magazine 4 and brought together with the beverage cans 9 such that the packaging blank 2 hereupon holds together the beverage cans 9 in a form-locking manner according to FIG. 4D.

Figure 5:
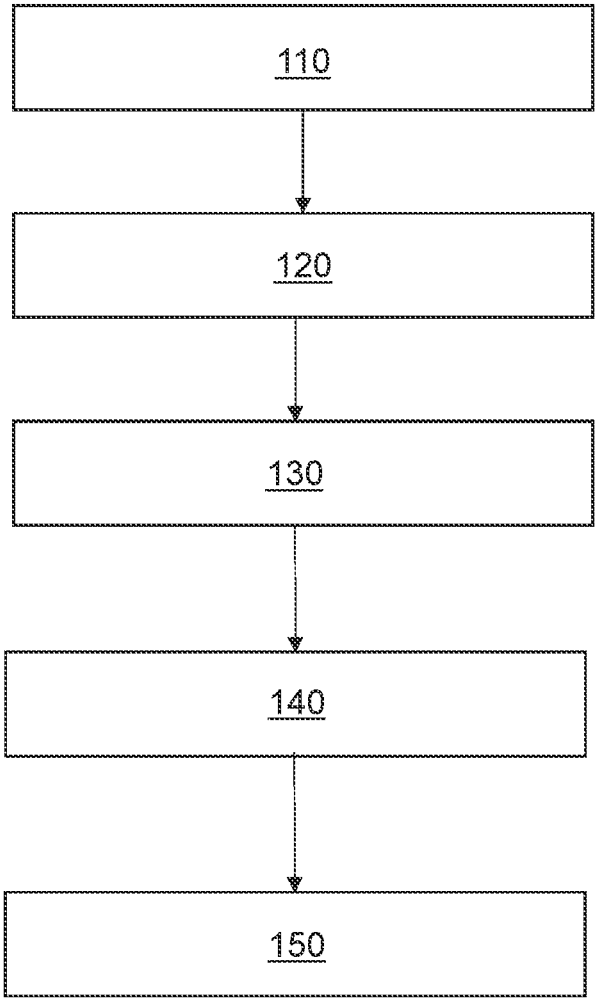
FIG. 5 shows a flowchart of individual steps such as can be provided individually or in the illustrated combination in various embodiments of the method according to the invention.
Figure 5:
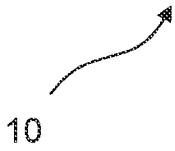

FIG. 5 shows a flowchart of individual steps such as can be provided individually or in the illustrated combination in various embodiments of the method 10 according to the invention. The method 10 described with FIG. 5 can be carried out by a device 1 corresponding to the exemplary embodiment according to FIGS. 1 and 2. Furthermore, it is possible to use packaging blanks 2 as illustrated in the FIG. 4 to carry out the method 10.

In a first step of method 10, the step being referred to with number 110 in FIG. 5, a plurality of packaging blanks 2 are positioned in a magazine 4 in an upright standing manner and arranged one after the other. A manipulator can be provided for this purpose to receive the plurality of packaging blanks 2 and then position them in the magazine 4 in an upright standing manner and arranged one after the other. It is also possible that a user positions the plurality of packaging blanks 2 in the magazine 4 in an upright standing manner and arranged one after the other.

In step 120, a packaging blank 2 arranged in the magazine 4 foremost in an upright standing manner is printed onto while this packaging blank 2 arranged in the magazine 4 foremost in an upright standing manner is still inside the magazine 4. The printing can be carried out according to the description for FIG. 3, for example, with a single printhead 15 applying a particular print image onto a front side 22 and onto a side wall 24 of a particular folded packaging blank 2. When the printing is fully completed, step 130 is carried out, in which the packaging blank 2, by then printed onto and up to then still arranged in an upright standing manner in the magazine 4, is extracted from the magazine 4 and deposited at a target location 20.

The method step 140 follows hereupon, in which the packaging blank 2 already deposited at the target location is brought together with a plurality of articles, with the plurality of articles being placed in a direction coming from above into the packaging blank 2 already deposited at the target location 20. In step 150, the packaging blank 2 is then closed and hereby forms a packaging unit together with the articles placed therein.

The invention has been described with reference to a preferred embodiment. Those skilled in the art will appreciate that numerous changes and modifications can be made to the preferred embodiments of the invention and that such changes and modifications can be made without departing from the spirit of the invention. It is therefore intended that the appended claims cover all such equivalent variations as fall within the true spirit and scope of the invention.

LIST OF REFERENCE CHARACTERS

1 Device
2 Outer packaging
4 Magazine

6 Transfer apparatus
7 Lateral edge area
8 Suction apparatus and/or gripping apparatus
9 Beverage can
10 Method
12 Printing apparatus
15 Printhead
17 Bundle
20 Target location
22 Front side
24 Side wall
27 Print image
S Control apparatus and/or regulating apparatus
110 First method step
120 Second method step
130 Third method step
140 Fourth method step
150 Fifth method step

The invention claimed is:

1. A method (10) used to package articles into printed packaging blanks (2), comprising:

positioning of a plurality of packaging blanks (2) in a magazine (4);

extracting the packaging blanks (2) from the magazine (4); and bringing together of the extracted packaging blanks (2) with at least one article, and further comprising printing onto the packaging blank (2), wherein at least one printhead (15) prints onto a packaging blank (2) while the packaging blank (2) is located in the magazine (4).

2. The method of claim 1, wherein the plurality of packaging blanks (2) are positioned in the magazine (4) in an upright standing manner and arranged one after the other.

3. The method of claim 2, wherein the extracting step comprises extracting the packaging blank (2) from the magazine (4) by a suction device or gripping device (8) temporally after the printing, wherein a movement of the suction device or gripping device (8) and a travel movement of the at least one printhead (15) are temporally coordinated with each other such that the suction device or gripping device (8) and the at least one printhead (15) do not collide with each other.

4. The method of claim 3, wherein the extracting step comprises extracting a foremost packaging blank (2) from the magazine (4).

5. The method of claim 2, wherein the at least one printhead (15) comprises a first printhead and a second printhead or is formed by a first printhead and a second printhead, and wherein:

the first printhead and the second printhead print onto the packaging blank (2) or the first printhead prints onto the packaging blank (2), while the second printhead remains in a waiting position temporally during the printing onto the packaging blank (2) by the first printhead.

6. The method of claim 5, wherein the first printhead and the second printhead interact in order to print onto a foremost packaging blank (2) in the magazine (4), or wherein the first printhead prints onto a foremost packaging blank (2), while the second printhead remains in a waiting position temporally during the printing onto the foremost packaging blank (2) by the first printhead.

7. The method of claim 2, further comprising sensing, with a sensor system, whether a packaging blank (2) is located within a defined print range of the at least one printhead (15), and enabling or disabling approval for the at least one printhead (15) to print onto the packaging blank (2) depending on whether the packaging blank (2) is located within the print range.

8. The method of claim 7, further comprising sensing, with the sensor system, a position or orientation of the packaging blank (2) and coordinating a travel movement of the at least one printhead (15) with the position or orientation of the packaging blank (2) as determined by the sensor system.

9. The method of claim 2, wherein the at least one printhead (15) prints onto a foremost packaging blank (2) while the packaging blank (2) is located in the magazine (4).

10. The device of claim 9 further comprising a control apparatus or regulating apparatus (S) and a sensor system in operative connection with the control apparatus or regulating apparatus (S), wherein the control apparatus or regulating apparatus (S) can check, by the sensor system, whether a packaging blank (2) positioned in the magazine (4) is located within a defined print range, and wherein the control apparatus or regulating apparatus (S) is designed so that the control apparatus or regulating apparatus (S) issues an approval for the at least one printhead (15) to print onto a particular packaging blank (2) if the control apparatus or regulating apparatus (S) determines that a packaging blank (2) is located within the print range, and wherein control apparatus or regulating apparatus (S) is designed so that the control apparatus or regulating apparatus (S) disables an approval for the at least one printhead (15) to print onto a particular packaging blank (2), if the control apparatus or regulating apparatus (S) determines that no packaging blank (2) is located within the print range.

11. The device of claim 10, wherein the sensor system and the at least one printing apparatus (12) are in operative connection with each other such that a travel movement of the at least one printhead (15) is coordinated with a particular position or orientation of a particular packaging blank (2) positioned in the magazine (4).

12. The device of claim 9, wherein the transfer apparatus (6) comprises a suction device or gripping device (8) wherein:

a travel movement of the at least one printhead (15) is coordinated with a movement of the suction device or gripping device (8) such that the suction device or gripping device (8) and the at least one printhead (15) do not collide with each other.

13. The method of claim 1, wherein the packaging blanks (2) are printed onto temporally after the positioning of the packaging blanks (2) in the magazine (4) and temporally before the extraction of the packaging blanks (2) from the magazine (4).

14. The method of claim 1, wherein the packaging blanks (2) are also printed onto temporally during extraction of the packaging blanks (2) or temporally during a transport of the extracted packaging blank (2) toward the articles.

15. The method of claim 14, wherein the packaging blank (2) is extracted from the magazine (4) by a suction device or gripping device (8) and transported toward the particular articles with which the extracted packaging blank (2) is then brought together, wherein the suction device or gripping device (8) prints onto the particular packaging blank (2) temporally during the extracting of the packaging blank (2) or temporally during the transport of the extracted packaging blank (2) toward the particular articles.

16. A device (1) used to handle packaging blanks comprising:

a magazine (4) for packaging blanks (2);

a transfer apparatus (6) adapted to extract packaging blanks (2) from the magazine (4) and transport the packaging blanks (2) toward articles to be packaged into the packaging blanks (2); and at least one printing apparatus (12) used to print onto packaging blanks (2), wherein the at least one printing apparatus (12) is adapted to print onto packaging blanks (2) stored in the magazine (4), or wherein the at least one printing apparatus (12) is arranged at, or supported by, the transfer apparatus (6).

17. The device of claim 16, wherein the at least one printing apparatus (12) comprises a first printhead and a second printhead, wherein:

the first printhead and the second printhead print onto a packaging blank (2) or the first printhead or the second printhead prints onto the packaging blank (2) while the other printhead is in a waiting position.

18. The device of claim 16, wherein the packaging blanks (2) can be supplied by the magazine (4) in an upright standing manner and arranged one after the other.

19. The device of claim 18, wherein the at least one printing apparatus (12) comprises at least one printhead (15) which can print onto a packaging blank (2) located in the magazine (4).

20. The device of claim 19, wherein the at least one printhead (15) can print onto the packaging blank (2) located foremost in the magazine (4).

* * * * *